United States Patent [19]

Rosser

[11] Patent Number: 4,570,913

[45] Date of Patent: Feb. 18, 1986

[54] CLAMPING APPARATUS FOR TRUSS MANUFACTURING EQUIPMENT

[75] Inventor: Michael C. Rosser, Roanoke, Tex.

[73] Assignee: Production Equipment & Engineering Co., Fort Worth, Tex.

[21] Appl. No.: 570,024

[22] Filed: Jan. 11, 1984

[51] Int. Cl.[4] ..... B30B 15/00

[52] U.S. Cl. ..... 269/22; 269/157; 269/910

[58] Field of Search ..... 269/20, 22, 25, 157–163, 269/253, 910; 254/93 HP; 29/281.3

[56] References Cited

U.S. PATENT DOCUMENTS

| | | | |
|---|---|---|---|
| 2,560,902 | 7/1951 | Smith | 269/22 |
| 2,686,960 | 8/1954 | Le Roy | 269/253 |
| 3,186,173 | 6/1965 | Hogg | 269/25 |
| 3,237,252 | 3/1966 | Ratcliffe | 269/22 |
| 3,345,897 | 10/1967 | Parson | 269/22 |
| 4,143,448 | 3/1979 | Caster et al. | 269/22 |
| 4,379,426 | 4/1983 | Thompson et al. | 269/910 |

*Primary Examiner*—Robert C. Watson

*Attorney, Agent, or Firm*—John F. Booth; Gerald G. Crutsinger; Monty L. Ross

[57] ABSTRACT

A clamping means is disclosed for use in clamping wooden chord and web members together in manufacturing wooden trusses. The clamping means uses an inflatable conduit to force an elongated clamp to a closed position.

3 Claims, 3 Drawing Figures

CLAMPING APPARATUS FOR TRUSS MANUFACTURING EQUIPMENT

TECHNICAL FIELD

The present invention relates generally to apparatus for assembling precut wooden chord and web members into floor and roof trusses by use of metal plate connectors. More particularly, this invention concerns a clamping apparatus for use in positioning the chord and web members in position during assembly of the truss.

BACKGROUND ART

Prefabricated wooden trusses are being utilized in the construction industry. Such trusses are typically assembled at a manufacturing facility and then transported to the job site for incorporation into the building. The use of these prefabricated structures can result in substantial cost saving by decreasing the amount of time and labor required to complete a project. In addition, these trusses are generally lighter in weight and more efficiently engineered than their on the site preassembled counterparts.

Prefabricated wooden truss rafters for use as floor or roof supports are examples of components which are preassembled and used widely in the construction industry. Such trusses are assembled from precut wooden chord and web members positioned in an abutting relationship and connected together by use of metal connector plates.

Although trusses of this type can be fabricated by hand on a production line basis, several truss assembly machines have been developed for performing this task in a semiautomated manner. One such machine is disclosed in prior U.S. Pat. No. 4,295,269 to Wright. In general, this patent discloses a device in which precut wooden members are positioned manually over a support or work table. The members are clamped in place after which a toothed metal fastener is laid over the abutting joints. The fastener plates are pressed into the wooden members to secure the joints while the members are held by clamping assembly.

Various arrangements of tables and clamping assemblies have been employed in the prior art such as those shown in the above mentioned U.S. Pat. No. 4,295,269, and the patents cited therein. Typically, the truss components are laid flat on a table and abutted against a fixed brace. A clamping assembly is positioned on the opposite side of the truss and is movable between an open and closed position. In the open position, sufficient space is provided between the fixed base and the clamping assembly to allow placement of the truss components therebetween. In a closed position, the clamp closes on the truss components and clamps or presses them against the fixed brace. In the prior art, this clamping means comprised an elongated bar of a sufficient length to contact one side of the truss and a mechanical device such as a screw, lever or toggle means is provided to apply closing force to the elongated member at spaced points. In other prior art devices, pneumatic or hydraulic cylinders contact the elongated member at spaced points and apply force thereto. The prior art clamping apparatus which contact the elongate member at space points can in some cases tend to deform the elongate member and truss assembly itself. This limits the capability of the prior art truss manufacturing devices.

DISCLOSUURE OF THE INVENTION

The present invention comprises an apparatus for clamping wooden truss chord and web members in position which overcomes the foregoing difficulties associated with the prior art. In accordance with the invention, there is provided a truss clamping apparatus including a truss assembly table with a fixed brace against which the one side of the truss abuts. In addition, a movable clamping means is provided having a fixed elongated L shape member with one flange of the L bolted to the surface of the table. A second L shape bracket is resiliently connected to the first L shape bracket and has a surface thereon for contacting the other side of the wooden truss. Positioned between the two elongated L shape brackets is an inflatable conduit preferably of resilient material. Pneumatic supply and control means are provided for selectively inflating the conduit to cause the second L shape bracket to be forced in a clamping direction away from the first L shape bracket.

The advantage of this device is that the inflatable conduit provides a uniform pressing force along its length as it is inflated. There are no discrete pressure points where hydraulic cylinders, mechanical screws or the like contact the movable L shape bracket and therefore distortions in the L shape bracket contacting the truss are minimized if not completely eliminated. A spring return means is provided between the two L shape brackets to resiliently return the second L shape bracket to the open position when the pressure is removed from the inflatable conduit.

BRIEF DESCRIPTION OF THE DRAWINGS

A more complete understanding of the present invention can be had by referring to the following detailed description conjunction with the accompanying drawings wherein.

DETAILED DESCRIPTION

Figure 1:
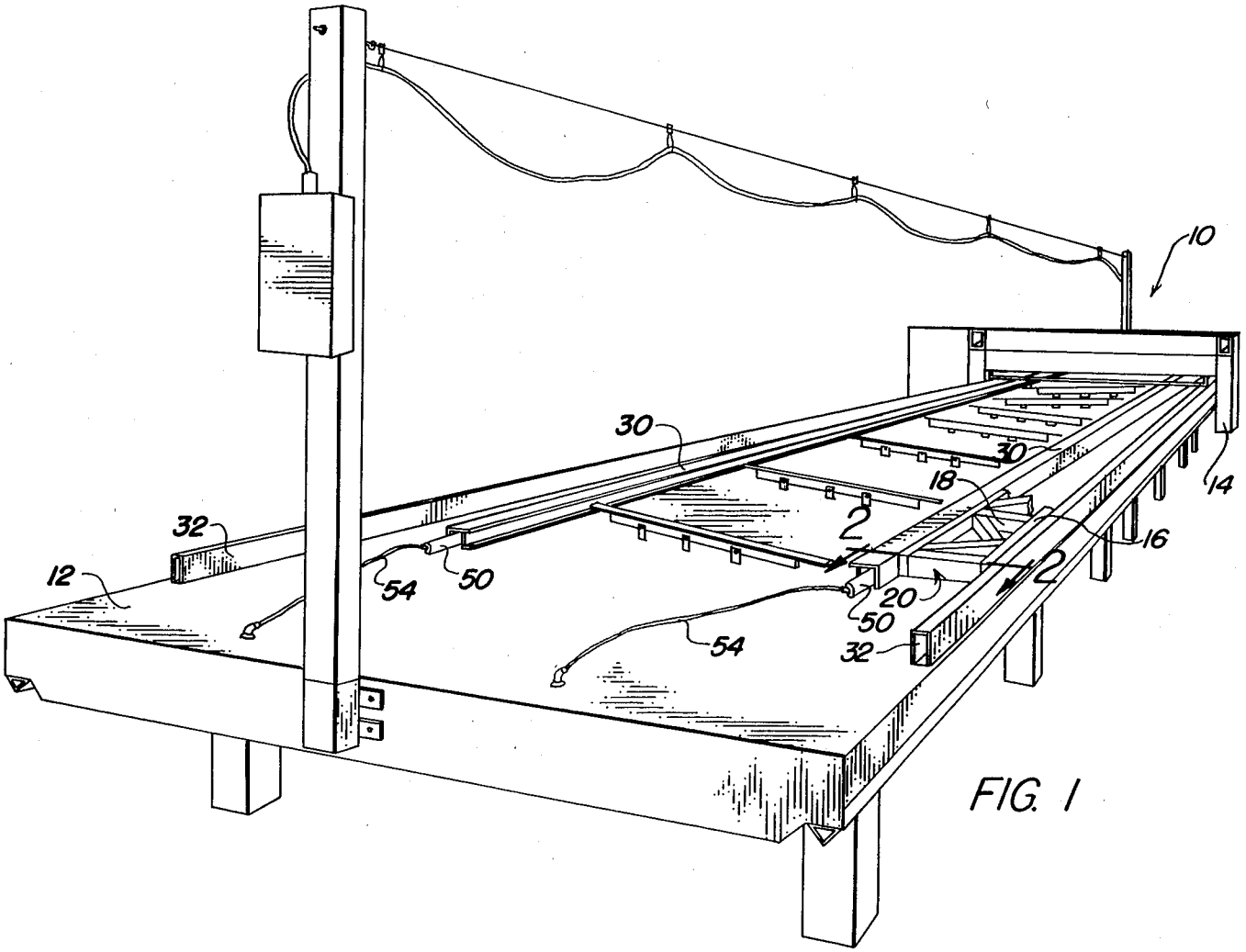
FIG. 1 is a top perspective view of a truss assembly apparatus table with the clamping apparatus of the present invention installed thereon.

Referring now to the drawings, wherein identical reference numerals designate like or corresponding parts throughout the several views, and particularly to FIG. 1, there is shown a truss assembly apparatus 10 embodying the improved clamping apparatus of the present invention.

The apparatus 10 is of the type shown in U.S. Pat. No. 4,295,269, and comprises a jig table 12 and a presser carriage 14 supported for movement therealong. The table 12 rests on the floor and forms a flat elongated planar work surface thereon. As is described in U.S. Pat. No. 4,295,269, the presser carriage 14 straddles the table 12 and is supported for powered movement along the table. Presser carriage 14 has a roller not shown for pressing metallic toothed or barbed fastener or nail plates into the chord 16 and web member 18 of a wooden truss 20. The pointed metal fastener plates 22 are utilized to connect the wooden components of the truss together.

According to a particular feature of the present invention, the table 12 has a pair of the improved clamping assemblies 30 thereon. Clamping assembly 30 is utilized to clamp the truss 20 against an outer brace 32. Brace 32 is affixed on the table 12. In the present embodiment, the outer brace comprises a metallic square tubular member extending along the length of the table 12.

According to a particular feature of the present invention, the clamping assembly 30 comprises an elongated clamping member which likewise extends along the length of the table as shown. The clamping assembly 30 is shown in detail in FIG. 2 and comprises a first elongated L shape bracket 34 and a second elongated L shape bracket 36. The brackets 34 and 36 are made from metallic material such as steel which has a sufficient rigidity to accommodate the clamping forces applied by the clamping assembly.

The L shape bracket 34 has one flange 34*a* resting upon the surface of the table 12 and is rigidly affixed in position by bolts 38 which engage threaded openings not shown in the surface of the table 12. By providing a plurality of threaded openings in the table, the bracket 34 can be bolted down upon the surface of the table in various positions to accommodate various sizes of trusses. The elongated bracket 34 has a second flange 34*b* which extends up from the surface of the table 12 in a direction transverse to the work surface. This flange 34*b* in the embodiment shown has a plurality of spaced pairs of clearance openings 40 formed therein for receiving guide rods 42. Rods 42 extend from the bracket 36.

Bracket 36 has a flange 36*a* which rests on the surface of the table 12 and a flange 36*b* which rests upon the upper end of flange 34*b*. Both the flanges 36*a* and 36*b* slide with respect to the table and the flange 34*b* in the forward and reverse direction of arrow 44. The guide rods 42 slide in the clearance openings 40 to assist in maintaining the bracket 36 in proper position. A compression spring 46 is mounted around the guide rod 42. Retainer means 48 are attached to the guide rods to mount the springs thereon. The springs 36 contact the flange 34 and resiliently urge the guide rods 42 in the reverse direction of arrow 44.

According to a particular feature of the present invention, an elongated resilient inflatable conduit 50 is positioned within the elongated cavity 52 formed between the flanges 36*a*, 36*b*, 34*b*, and the upper surface of the table 12. The conduit can be made from collapsible air hose. This conduit 50 is sealed at both ends and is coupled to a suitable supply of pressurized gas such as air as shown in FIG. 1 by air hose 54. It is to be understood, of course, that a suitable pump, reservoir and valve means can be provided for selectively controlling the supply of pressurized air to the inflatable conduit 50.

The operation of the clamping assembly 30 can best be described by reference to FIGS. 2 and 3. In FIG. 3, the clamp assembly 30 is shown in the open position with the conduit 50 compressed to a constricted or collapsed position by the action of the springs 46. To close the clamp assembly 30, pressurized air is supplied through a suitable valve to the interior of the conduit 50 which in turn inflates the conduit to the position shown in FIG. 2. This inflation of the conduit 50 causes the bracket 36 to move in the direction of the arrow 44 and contact the cord 16 of the truss 20 and compress the truss against the bracket 32.

By reason of the fact that the conduit 50 is inflatable and maintained at a uniform pressure, the force of the conduit exerted between the flange 34*b* and 36*a* is uniform along the length of the clamp assembly 30. This eliminates deformations in the movable bracket 36 caused in conventional systems by the spaced contact points with the pneumatic cylinder or other actuating means.

Figure 2:
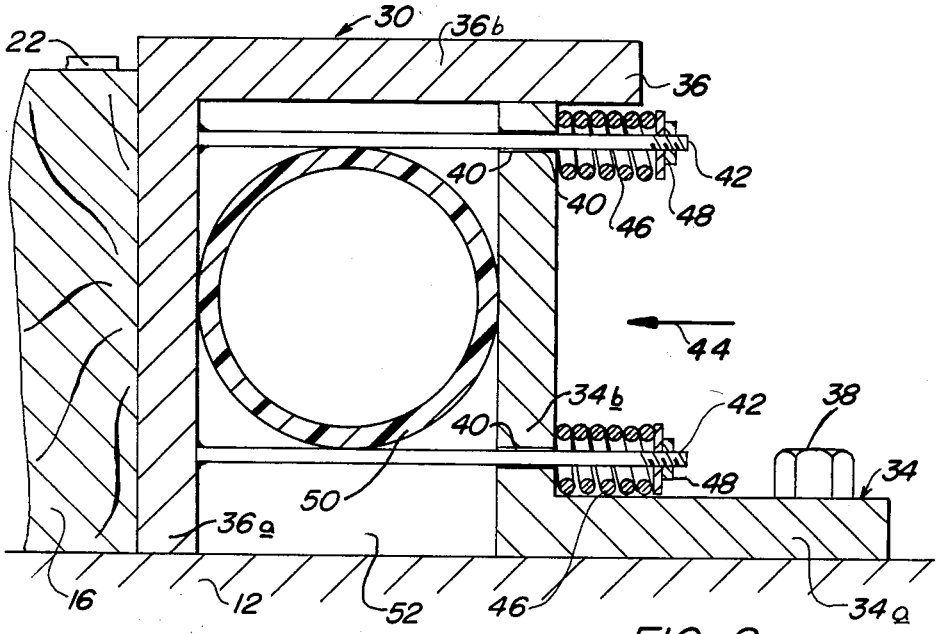
FIG. 2 is an enlarged partial sectional view taken along line 2—2 of FIG. 1 looking in the direction of the arrows showing the clamping apparatus in the open position.
Figure 3:
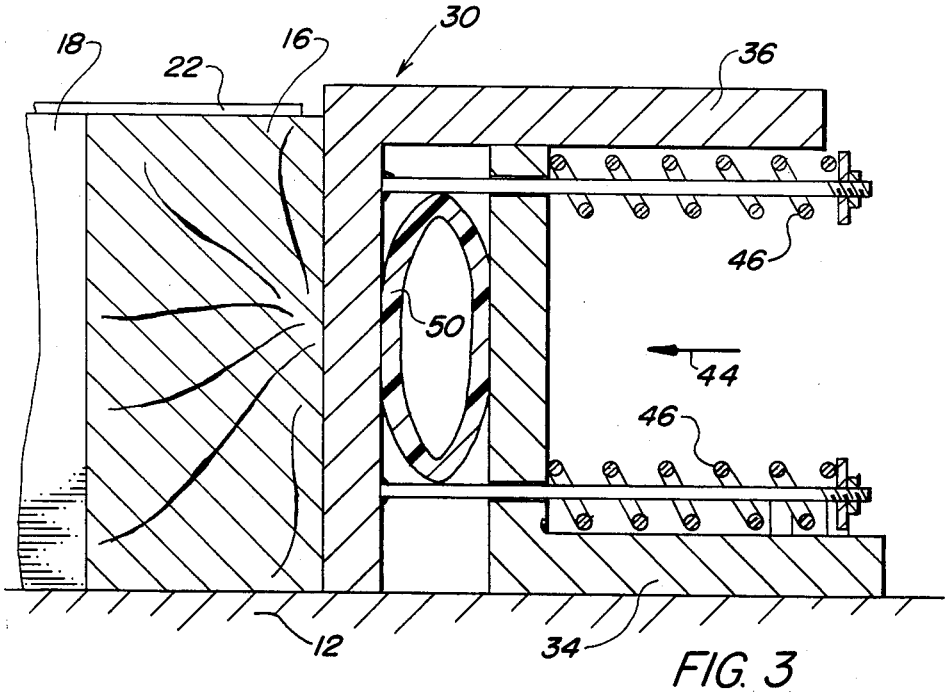
FIG. 3 a view similar to FIG. 2 showing the clamping apparatus of the present invention in the open position.

To return the clamp from the closed position shown in FIG. 2 to the open position shown in FIG. 3, the valve (not shown) is open to release the pressure from the interior of the conduit whereby the conduit 50 is vented to an atmospheric pressure and compressed by springs 46.

From the foregoing, it will be understood that the present invention comprises an improved clamping apparatus for use in truss assembly devices and that the clamping apparatus provides a uniform force along the length hereof thus providing advantages over the prior art. Although the device is shown in a preferred embodiment of the invention, it is to be understood, of course, that the invention is not limited to only the embodiment illustrated, but is intended to embrace any alternative modifications and rearrangements and/or substitution of elements that fall within the spirit and scope of the invention. For example, other shapes of brackets and guide means could be utilized with an inflatable conduit to provide the uniform pressure of the present invention.

I claim:

1. A clamping apparatus operable by a controlled pneumatic source for use on a table in fabricating wood trusses having chords and web components joined together by metal plates comprising:

a first elongated "L" shaped bracket having an outwardly extending flange, means for releaseably fixing said flange of said first bracket to the surface of the table, a second elongated "L" shaped bracket means for engaging substantially the full length of a chord of said wood truss, means for movably supporting said second bracket from the surface of said table and from an upwardly extending flange of said first bracket, and an elongated inflatable conduit positioned between said first and second brackets, said conduit being inflatable between a constricted and inflated position whereby said conduit when inflated forces said second bracket means to move in a direction away from said first bracket to engage the chord of said wood truss applying a pressing force substantially uniformly along the length of said chord.

2. The clamping means of claim 1 additionally comprising stop means limiting the movement of said second bracket in a direction away from said first bracket and resilient return means for resiliently urging said second bracket in a direction toward said first bracket.

3. An apparatus for fabricating wood trusses having chords and web components joined together by toothed metal plates comprising:

a rigid truss assembly table forming a work surface for receiving truss components thereon, at least one clamping assembly for engaging the chords of the truss components, said assembly comprising: first elongated means fixed to said table for engaging substantially the full length of one chord of said truss, second means fixed to said table and spaced from said first means and movable to engage said truss and clamp said truss between said first and second means, said second means comprising an elongated first "L" shaped bracket removably connected to said table, a flange on said first elongated bracket extending upwardly from the work surface of the table, an elongated second "L" shaped bracket, a flange on said second bracket extending downwardly toward the work surface of said table and supply means for providing a control supply of pressurized compressible gas, an inflatable conduit positioned between said flanges on said first and second brackets and connected to said supply means, said conduit being inflatable between expanded and constricted positions, said conduit when inflated from said constricted to said expanded position causing said second bracket to move in a direction away from said first bracket whereby said second bracket contacts and clamps said truss against said fixed brace with a pressing force substantially uniform along the length of said chord.

* * * * *

UNITED STATES PATENT AND TRADEMARK OFFICE

CERTIFICATE OF CORRECTION

PATENT NO. : 4,570,913

DATED : February 18, 1986

INVENTOR(S) : Michael C. Rosser

It is certified that error appears in the above-identified patent and that said Letters Patent is hereby corrected as shown below:

On title page, References Cited, fifth reference cited, change "Parson" to -- Pearson --. In Column 2, line 37, after "description" insert -- in --.

Signed and Sealed this

*Fifth* Day of *August 1986*

[SEAL]

*Attest:*

DONALD J. QUIGG

*Attesting Officer*

*Commissioner of Patents and Trademarks*